United States Patent [19]

Jeanjean et al.

[11] Patent Number: 4,711,978

[45] Date of Patent: Dec. 8, 1987

[54] SULFUR HEXAFLUORIDE CIRCUIT-BREAKER FOR OPERATING IN A VERY LOW TEMPERATURE ENVIRONMENT

[75] Inventors: Robert Jeanjean, St-Lambert; Daniel Demissy, Montreal; Guy Saint-Jean, Longueuil; Michel Landry, Ste-Julie, all of Canada

[73] Assignee: Cegelec Industrie Inc., Lapraire, Canada

[21] Appl. No.: 8,446

[22] Filed: Jan. 29, 1987

[30] Foreign Application Priority Data

Jan. 29, 1986 [FR] France ..... 86 01252

[51] Int. Cl.[4] ..... H01H 33/88

[52] U.S. Cl. ..... 200/148 A; 200/150 G; 200/146 R

[58] Field of Search ..... 200/148 A, 150 G, 146 R

*Primary Examiner*—Robert S. Macon

*Attorney, Agent, or Firm*—Sughrue, Mion, Zinn, Macpeak, and Seas

[57] ABSTRACT

A sulfur hexafluoride circuit-breaker for operating in a very low temperature environment, the circuit-breaker being of the type comprising a sealed enclosure filled with sulfur hexafluoride and closed by first and second end plates, a set of fixed contacts, a set of moving contacts driven by an operating rod, a blast volume which is mechanically compressed when the operating rod is displaced to open the circuit-breaker, and blast nozzle for directing the said compressed gas from said volume onto the arc, the circuit-breaker including the improvement of means for creating an arc in said blast volume during a portion of the time that the moving assembly is moving, by diverting the current to be interrupted so that it flows through two parts constituting two electrodes.

4 Claims, 3 Drawing Figures

SULFUR HEXAFLUORIDE CIRCUIT-BREAKER FOR OPERATING IN A VERY LOW TEMPERATURE ENVIRONMENT

The present invention relates to a sulfur hexafluoride circuit-breaker for operating in a very low temperature environment.

BACKGROUND OF THE INVENTION

High voltage circuit-breakers exist comprising a sealed insulating enclosure having a set of fixed contacts and a set of moving contacts located therein, with each set of contacts including a main contact and an arcing contact.

The inside of the enclosure is filled with a dielectric gas which is at least partially constituted by sulfur hexafluoride at a pressure of several bars.

When the temperature of the circuit-brealer's environment falls, the temperature of the gas inside the circuit-breaker also falls, thereby reducing its pressure.

Such a reduction in pressure lowers the dielectric strength of the circuit-breaker and this may lead to arcs being re-struck between the contacts during circuit interruption.

An aim of the present invention is to provide a circuit-breaker which will continue to operate properly even when the surrounding temperature falls.

SUMMARY OF THE INVENTION

The present invention provides a sulfur hexafluoride circuit-breaker for operating in a very low temperature environment, the circuit-breaker being of the type comprising a sealed enclosure filled with sulfur hexafluoride and closed by first and second end plates, a set of fixed contacts, a set of moving contacts driven by an operating rod, a blast volume which is mechanically compressed when the operating rod is displaced to open the circuit-breaker, and blast nozzle for directing the said compressed gas from said volume onto the arc, the circuit-breaker including the improvement of means for creating an arc in said blast volume during a portion of the time that the moving assembly is moving, by diverting the current to be interrupted so that it flows through two parts constituting two electrodes.

A preferred embodiment of the invention is described by way of example with reference to the accompanying drawings, in which.

DESCRIPTION OF PREFERRED EMBODIMENT

Figure 1:
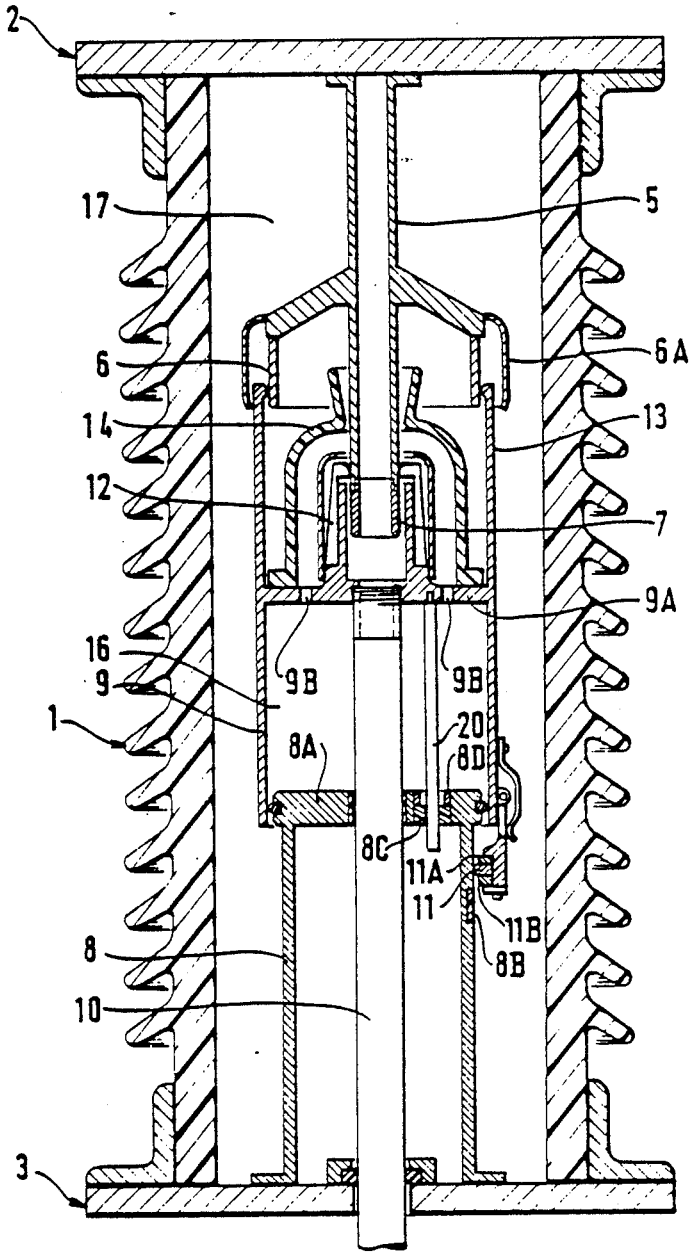
FIG. 1 is a fragmentary axial section through one pole of a circuit-breaker in accordance with the invention and shown in its closed position.

The circuit-breaker pole shown in the figures comprises:

An insulating envelope 1 for holding the operating pressure and closed in sealed manner at each end by respective metal end plates 2 and 3 which are provided with high-current connection points.

A set of fixed contacts which comprises a metal support 5 supporting a main contact 6 which is made of a substance capable of conveying high current at low loss, e.g. silver-plated copper, and an arcing contact 7 which is made of a substance capable of withstanding the damaging efects of arcing, e.g. a copper tungsten alloy. The fixed main contact is surrounded by a corona screen 6A.

And a set of moving contacts which comprises:

(a) A metal cylinder 8 for transferring electric current, said cylinder being mounted on end plate 3 and closed by a cap 8A constituting a piston.

(b) A hollow cylinder 9 capable of being moved by a control rod 10 which is fixed to a disk 9A closing the cylinder. The disk 9A has orifices 9B.

(c) A sliding contact 11 for transferring electric current and preferably comprising a silver-plated copper contact electrode which is surrounded on either side by switching electrodes 11A and 11B for preventing the copper contacts from being destroyed during successive opening and closing operations.

(d) An arcing contact 12 constituted by contact fingers, for example made of copper tungsten alloy and fixed to the disk 9A.

(e) A main contact 13 having silver-plated copper fingers covered by an aluminum corona screen cap 19.

(f) A blast nozzle 14 made of reinforced PTFE and fixed to the disk 9A.

Reference 16 designates the inside volume delimited by the cylinder 9 and the piston 8A, while reference 17 designates the volume outside the contact assemblies.

The metal cylinder 8 includes an insulating portion 8B on the path of the contact 11 for a purpose which is described below.

Finally, the circuit-breaker has a metal rod 20 which is fixed to the disk 9A and which passes through the cap 8A via an opening which is insulated by a lining 8C. The opening is fitted with a tungsten washer 8D and the distance between the washer 8D and the rod is carefully calibrated.

The circuit-breaker operates as follows.

Closed position

When the circuit-breaker is in its closed position, the gas pressure in the enclosure 16 is equal to that in the chamber 17. Electric current then flows via parts: 2, 5, 6, 13, 9, 11, 8, and 3.

Opening operation

When the circuit-breaker opens, the cylinder 9 moves, thereby compressing the volume 16 against the piston 8A. The main contact 13 and the arcing contact 12 of the moving assembly remain momentarily in contact with their corresponding contacts in the fixed assembly.

Figure 2:
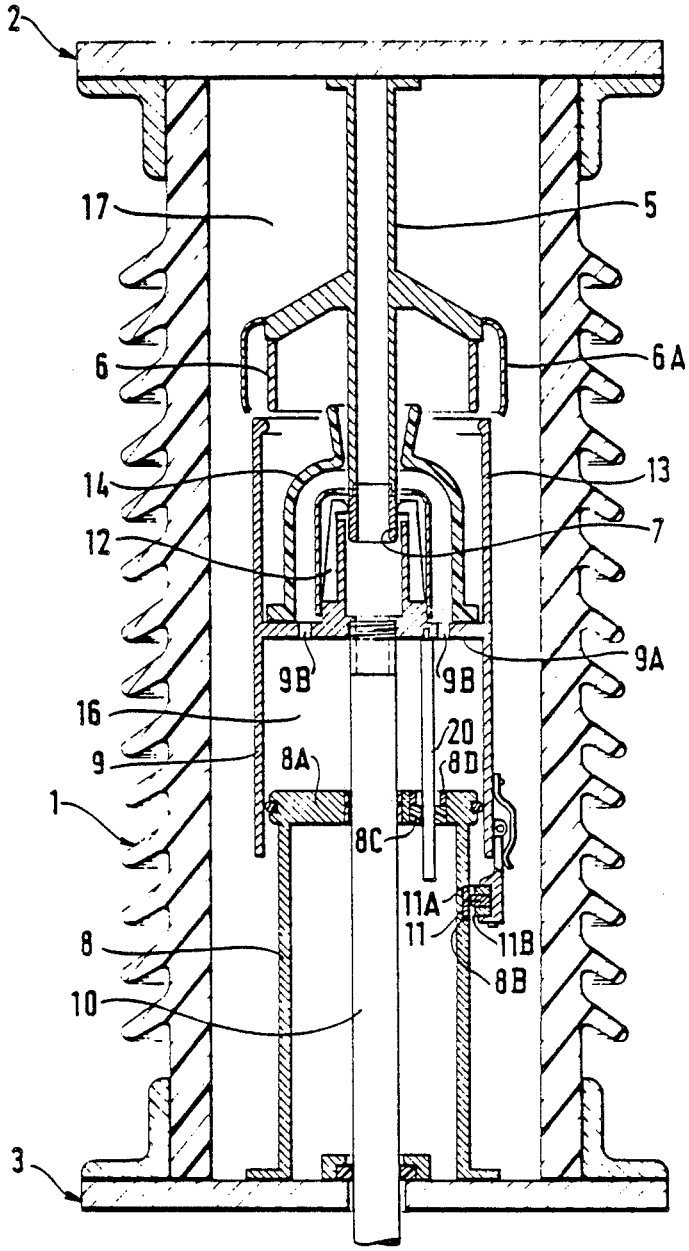
FIG. 2 is a view similar to FIG. 1, showing said pole in the course of being opened.

When the main contacts 6 and 13 separate (see FIG. 2) the arcing contacts 7 and 12 continue to pass electric current. The sliding contact 11 now arrives on the insulated section 8B, followed by its switching electrode 11A. The electric current is thus diverted to the rod 20 via an arc which is established between the rod and the washer 8D.

The diverted current thus passes through the parts 2, 5, 7, 12, 9A, 20 8D, 8, and 3. The electric arc heats the $SF_6$ gas and the pressure rises in the blast enclosure 16. (A variant of the invention consists in increasing the nominal pressure of the apparatus so as to have liquid $SF_6$ at temperatures below 0° C. In this case, the increase in pressure due to the liquid vaporizing is added to the above phenomenon). The sliding contact 11 then returns to a conducting section, preceded by its switching electrode 11B. The electric current then flows via parts 2, 5, 6, 13, 9, 11, 8, and 3.

Figure 3:
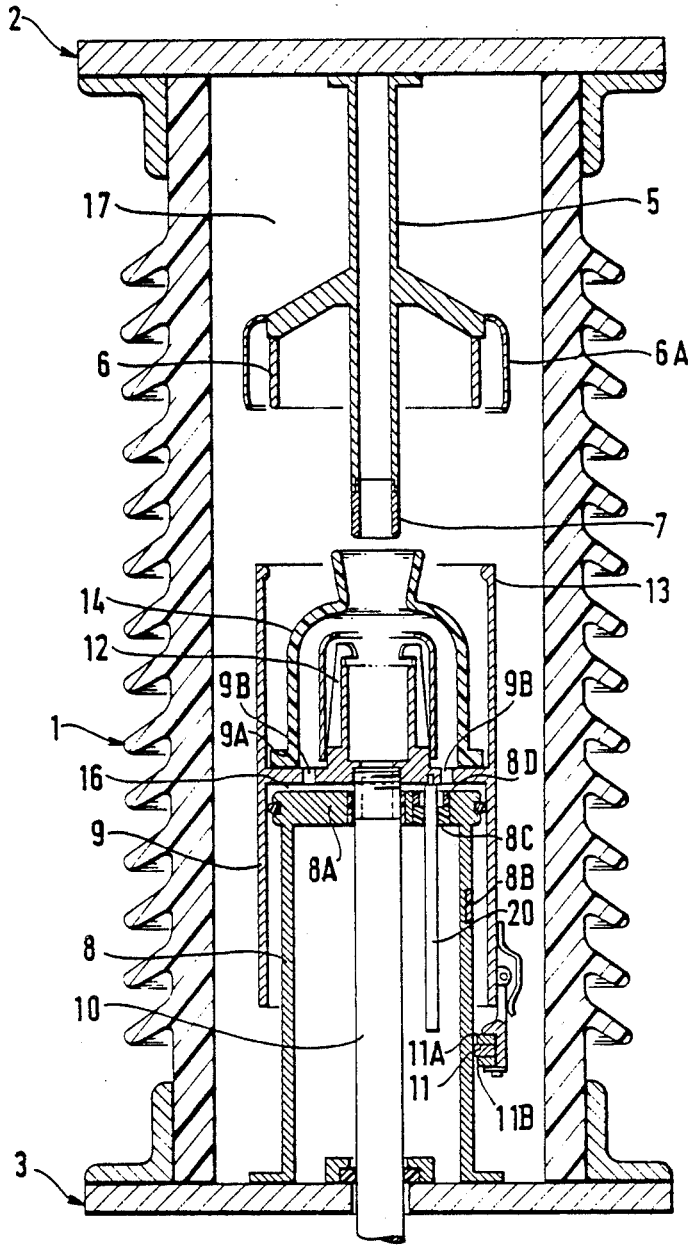
FIG. 3 is a similar view to FIGS. 1 and 2 showing said pole in its open position.

When the arcing contacts 7 and 12 separate (see FIG. 3), an arc is struck between these contacts.

As soon as the throat of the nozzle has gone beyond the end of the fixed contact 7, the gas inside the enclosure 16 which has been highly compressed by the combined action of the mechanical and thermal means implemented blasts the arc.

It can be seen that even if the outside temperature is very low, thereby reducing the $SF_6$ gas to a very low temperature and thus reducing its pressure, the heating provided by the current shortly before the blast serves to raise the gas pressure to a sufficiently high value to ensure that the arc is effectively blasted.

Closure operation

The cylinder 9 moves driving the sliding contact 11 followed by its switching electrode 11B on the part 8 until the arcing contacts 7 and 12 close. Electric current then passes through the parts 2, 5, 7, 12, 9, 11, 8, and 3. When the contact 11, preceded by its switching electrode 11A, arrives at the insulated zone 8B of the part 8, the current is then diverted via the parts 2, 5, 7, 12, 9, 20, 8D, 8A, and 8 by virtue of an arc which is established between the parts 20 and 8D and which serves to heat the enclosure 16.

The pressure differance between the volume of the enclosure 16 and the volume of the enclosure 17 causes a blast to occur through the nozzle which delays or maybe even prevents pre-striking.

After the insulated zone 8B of the cylinder 8 has been passed, electric current again passes through the contact 11 and the cylinder 9 and thus through the arcing contacts and finally through the main contacts.

We claim:

1. In a sulfur hexafluoride circuit-breaker for operating in a very low temperature environment, the circuit-breaker comprising a sealed enclosure closed by first and second end plates and filled with sulfur hexafluoride, a set of fixed contacts, a set of moving contacts driven by an operating rod, means including a moving assembly coupled to said operating rod for defining a blast volume which is mechanically compressed when the operating rod is displaced to open the circuit-breaker contacts, and a blast nozzle for directing said compressed gas from said volume onto the arc, the improvement comprising means including two parts constituting two electrodes for creating an arc in said blast volume during a portion of the time that the moving assembly is moving, by diverting the current to be interrupted so that it flow through said two parts constituting said two electrodes.

2. A circuit-breaker according to claim 1, wherein said blast volume defining means comprises a first cylinder fixed to the set of moving contacts and engaged on a second cylinder, said second cylinder being fixed to the second end plate and being closed by a cap which constitutes a piston for the first cylinder, a sliding contact connecting the set of moving contacts electrically to the second cylinder, a metal rod mechanically and electrically linked to the moving assembly, said rod passing through said cap, at an insulating portion together with a calibrated ring, and an insulating zone provided on the surface of said second cylinder, such that the current is diverted when said sliding contact arrives on said insulating zone whereby said metal rod and said calibrated ring constitute said electrodes to create said arc in said blast volume.

3. A circuit-breaker according to claim 1 or 2, wherein said sliding contact comprises a silver-plated copper contact coupled on either side to copper tungsten electrodes.

4. A circuit-breaker according to claim 1 or 2, wherein the internal pressure is chosen so that liquid sulfur hexafluoride exists in said blast volume at ambient temperatures below zero degrees celsius.

* * * * *